US006065379A

United States Patent [19]

Shinno et al.

[11] Patent Number: 6,065,379

[45] Date of Patent: May 23, 2000

[54] FINISHER WITH A PUNCHING FUNCTION

[75] Inventors: Tatsuya Shinno; Masayuki Tanaka; Hidekazu Sakawa, all of Toyokawa, Japan

[73] Assignee: Minolta Co., Ltd., Osaka, Japan

[21] Appl. No.: 08/871,981

[22] Filed: Jun. 10, 1997

[30] Foreign Application Priority Data

Jun. 19, 1996 [JP] Japan ..... 8-158527
Jun. 19, 1996 [JP] Japan ..... 8-158528

[51] Int. Cl.[7] ..... B26F 1/24

[52] U.S. Cl. ..... 83/30; 83/357; 83/368; 83/618; 83/628

[58] Field of Search ..... 83/30, 167, 357, 83/571, 572, 618, 620, 622, 628, 360, 368, 369

[56] References Cited

U.S. PATENT DOCUMENTS 5,229,812 7/1993 Toyama et al. .

FOREIGN PATENT DOCUMENTS 4-129699 9/1990 Japan .

*Primary Examiner*—M. Rachuba
*Attorney, Agent, or Firm*—McDermott, Will & Emery

[57] ABSTRACT

A finisher provided with a punching unit which punches a sheet. The punching unit has five punching rods, a drive shaft which rotates to drive the punching rods, five pairs of circular cam and eccentric cam which are fitted around the drive shaft and a switching board which moves the drive shaft in its axial direction reciprocally at a specified pitch. With a one-pitch movement of the drive shaft in its axial direction, three of the five punching rods (in a three-hole mode) or two of the five (in a two-hole mode) come into contact with the respective eccentric cams, and the three rods or the two rods are moved to make three holes or two holes in a sheet. The selection between the three-hole mode and the two-hole mode is automatically carried out in accordance with the sheet size.

7 Claims, 16 Drawing Sheets

FINISHER WITH A PUNCHING FUNCTION

BACKGROUND OF THE INVENTION

1. Field of the Invention

The present invention relates to a finisher, and more particularly to a finisher which punches sheets ejected from an image forming apparatus.

2. Description of Related Art

In recent years, various kinds of sorters (finishers) for sorting image-formed sheets have been developed as optional attachments for image forming apparatuses such as electrophotographic copying machines and laser printers.

Some of these finishers have a function of stapling sheets and/or a function of punching sheets as well as a function of sorting sheets.

As for punching mechanism, there are two types: a type which punches sheets one by one while the sheets are being transported; and a type which punches a stack of sheets after sorting at a time. The former single punching type, as disclosed by Japanese Patent Laid Open Publication No. 4-129699, has a plurality of punching rods, and all the punching rods are driven simultaneously to punch a sheet.

However, the number of punch holes to be made in a sheet varies. For example, in the U.S.A., making two holes or three holes in a sheet is required according to the sheet size. The punching mechanism disclosed by the above-mentioned Japanese Publication, however, is for exclusive use to make two holes or to make three holes. Therefore, the operator must exchange punching units to attach one which makes a desired number of holes, which is troublesome. As for the latter stack punching type, it is well-known that a punching unit is moved in parallel to one side of a stack of sheets and stopped at specified positions on the way to make holes. However, this type of punching unit including its driving means is large, and the process speed is low.

Further, as for a finisher with which an operator selects a desired punch operation mode, the selecting operation is complicated, and there is fear that misselection may occur.

SUMMARY OF THE INVENTION

An object of the present invention is to provide a finisher which can punch a sheet speedily, the number and the positions of holes being varied by a simple mechanism.

Another object of the present invention is to provide a finisher wherein selection of a punch operation mode is easier, thereby avoiding occurrences of misselection.

In order to attain the objects, a finisher according to the present invention comprises a plurality of punching rods for making holes in a sheet; a drive shaft which rotates to drive the punching rods; a plurality of converting members which are fitted to the drive shaft at positions to face the punching rods respectively so as to convert a rotary movement of the drive shaft into linear movements of the punching rods; and switching means for actuating specified ones of the converting members selectively.

In the present invention, the number of punching rods is such a number to comply with required numbers of holes (for example, two holes and three holes). By the switching means, only specified ones of the converting members which comply with punching to make a required number of holes at required positions are actuated. Thereby, specified ones of the punching rods to make the number of holes at the positions are moved. The punching process may be carried out toward a single sheet which is being transported to a tray or may be carried out toward a stack of sheets on the tray.

According to the present invention, the number and the positions of holes can be varied by selecting punching rods to be moved, and it is not necessary to exchange punching units to attach one suited to make a required number of holes. Also, in the finisher according to the present invention, it is not necessary to move a punching unit to punch a sheet at a plurality of positions. Therefore, the finisher is mechanically simple and is improved in process speed.

Preferably, each of the converting members is a pair of circular cam and eccentric cam which are fixed around the drive shaft adjacent to each other in the axial direction of the drive shaft, and the switching means moves the drive shaft in the axial direction at a specified pitch to make either the circular cam or the eccentric cam come into contact with each of the punching rods. With rotation of the drive shaft, the punching rods which are in contact with the eccentric cams move, while the punching rods which are in contact with the circular cams do not move. Thus, only by sliding the drive shaft and the cams, the number and the positions of holes can be varied.

Further, another finisher according to the present invention comprises punching means which is operable to punch a sheet in a plurality punch operation modes; and control means for controlling the punching means to operate in a predetermined punch operation mode suited for the size of the sheet to be punched.

In the present invention, the punching means punches a sheet in a predetermined punch operation mode suited for the size of the sheet. In other words, when the sheet size is determined, the punch operation mode suited for the sheet size is automatically selected. This arrangement saves the operator trouble in selecting a punch operation mode, and misselection can be avoided.

The finisher further comprises registering means with which an operator can register a desired punch operation mode for each sheet size. In the structure, the operator can register desired punch operation modes for respective sheet sizes, for example, a three-hole mode for A3 size and a two-hole mode for B5 size. Thus, the punching means can be used in a punch operation mode as each user desires.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

Some embodiments of the present invention are described referring to the accompanying drawings. In the following embodiments, the present invention is applied to a staple sorter attached to an electrophotographic copying machine.

First Embodiment; See FIGS. 1–10

Figure 1:
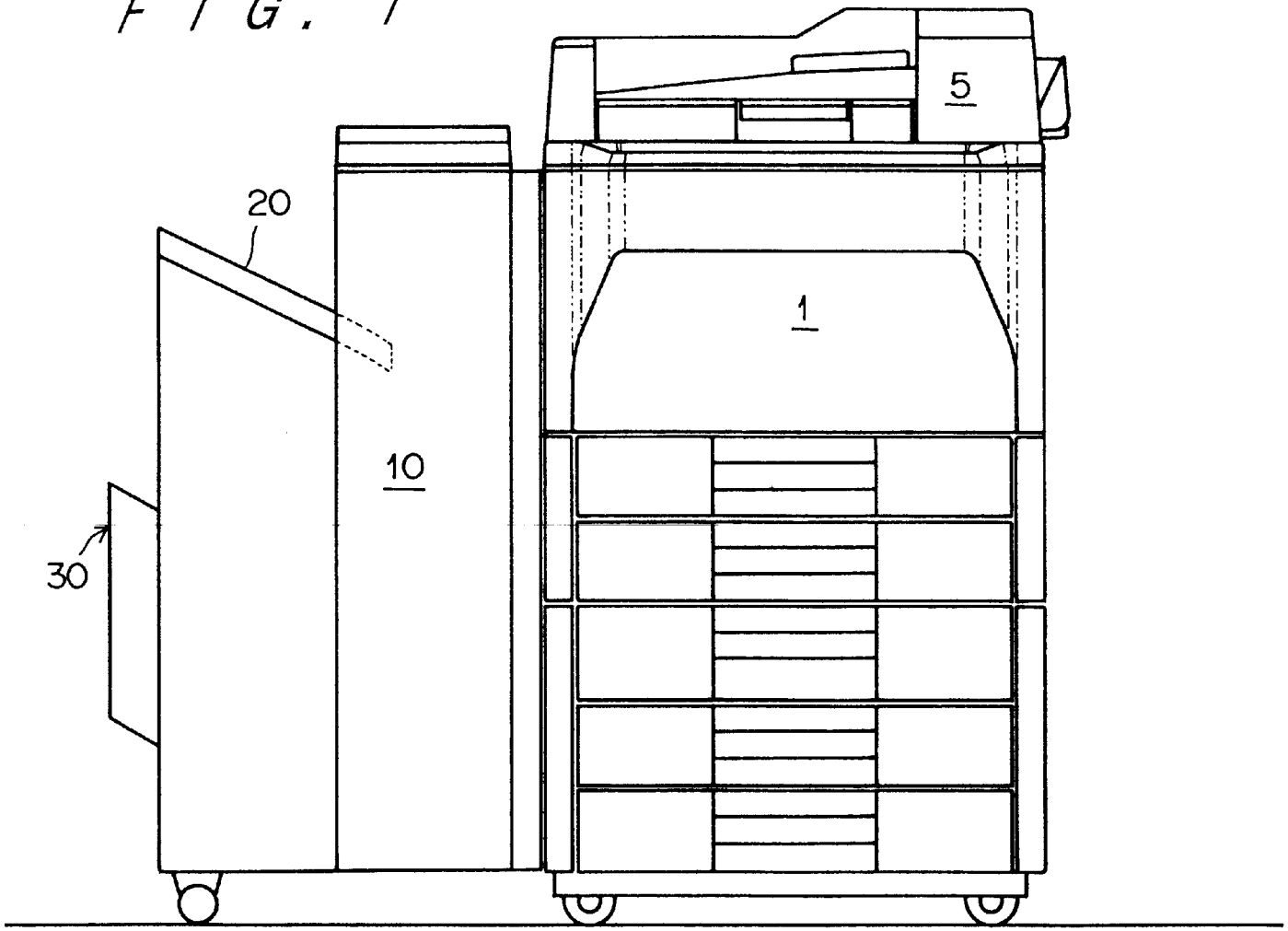
FIG. 1 is a front view of a copying machine and a staple sorter which is a first embodiment of the present invention.

In FIG. 1, the reference numerals 1 and 10 denote an electrophotographic copying machine and a staple sorter, respectively. The copying machine 1 forms an image on a sheet by a well-known electrophotographic method and has an automatic recirculating document feeder 5 on its top. The automatic document feeder 5 delivers original documents stacked on a tray sequentially onto a platen glass, and returns the documents sequentially from the platen glass onto the tray after exposure for making a number of copies specified by the operator.

Figure 2:
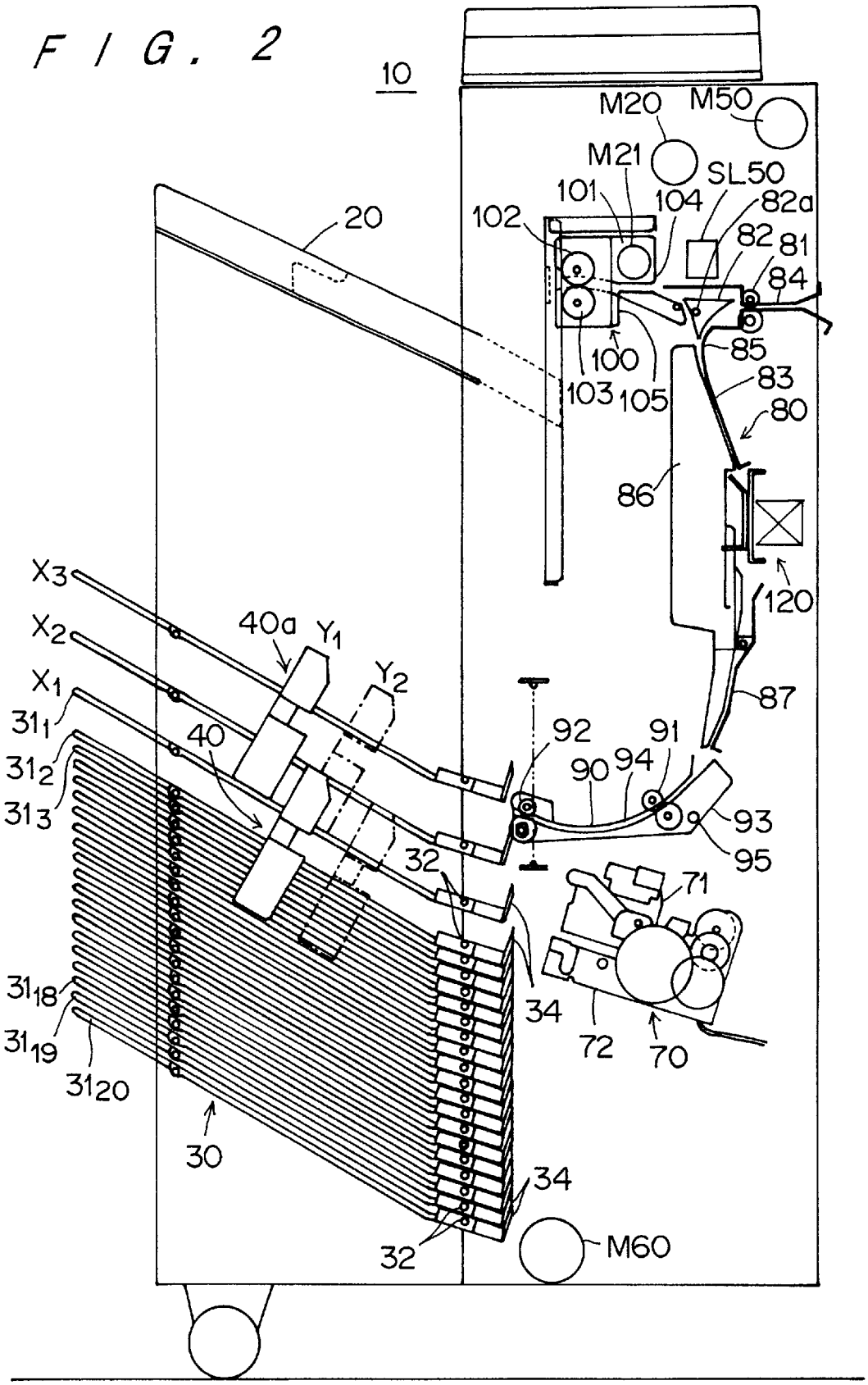
FIG. 2 is an elevational view of the staple sorter which shows the general structure thereof.

The staple sorter 10, as shown in FIG. 2, comprises a large-capacity non-sort tray 20, a bin assembly 30 having a stack of twenty bins 31, chucking units 40 and 40*a* for pulling a stack of sheets out of each bin 31, a stapling unit 70, a sheet conveyer section 80, a sheet conveyer gate 100 and a punching unit 120.

The staple sorter 1.0 is capable of handling image-formed sheets ejected from the copying machine 1 in the following modes: a non-sort mode of stacking sheets on the non-sort tray 20 without sorting, a sort mode of distributing sheets such that a collated set of sheets is stored in each bin 31, a sort/staple mode of stapling each collated set of sheets, a sort/stack mode of taking the collated and stapled sets of sheets out of the bins 31 and stacking the stapled sets of sheets on the non-sort tray 20, a group mode of distributing sheets such that sheets of the same page are stored in a bin 31, a group/staple mode of stapling sheets of the same page, a group/stack mode of taking the grouped and stapled sets of sheets out of the bins 31 and stacking the stapled sets of sheets on the non-sort tray 20. Further, a punch mode, in which sheets are punched one by one while being conveyed in the sheet conveyer section 80, is possible, and the punch mode can be carried out in a combination with either of the above modes.

Next, the internal structure of the staple sorter 10 is described in detail.

The sheet conveyer section 80 comprises a pair of receiving rollers 81 for receiving a sheet ejected from the copying machine 1, a diverter 82 for switching the direction in which the sheet is conveyed, a first sheet conveyer section 83 which extends substantially vertically, a second sheet conveyer section 90 which extends substantially horizontally from the first sheet conveyer section 83 toward the bin assembly 30. The diverter 82 is pivoted on a pin 82*a* to turn in accordance with the on or off state of a solenoid SL50. The diverter 82 is in a position shown by the solid line in FIG. 2 when the solenoid SL50 is off. In this state, a sheet received by the receiving rollers 81 is guided by a curved surface on the right side of the diverter 82 and transported into the first sheet conveyer section 83. When the solenoid SL50 is turned on, the diverter 82 turns slightly clockwise. In this state, a sheet is guided by the upper surface of the diverter 82 and transported to the non-sort tray 20 through the sheet conveyer gate 100 which will be described later.

The first sheet conveyer section 83 comprises guide plates 84, 85, 86 and 87, and a punching unit 120 for punching a sheet at a leading portion or a trailing portion with respect to the sheet conveying direction is provided in the middle part of the sheet conveyer section 83. The punching unit 120 will be described in detail later.

The second sheet conveyer section 90, which comprises pairs of conveyer rollers 91 and 92, and guide plates 93 and 94, is capable of pivoting on a support shaft 95 within an angle of approximately 90 degrees. In the sort mode or the group mode, the second sheet conveyer section 90 is set in its conveying position shown by the solid line in FIG. 2 to deliver sheets sent from the first sheet conveyer section 83 into the bins 31. In a process for taking sheets out of the bins 31, which will be described later, the second sheet conveyer section 90 pivots approximately 90 degrees clockwise on the support shaft 95 and becomes in a vertical posture (see FIGS. 5*a*–5*f*) to retreat from the sheet conveying position.

The pairs of rollers 81, 91 and 92 are driven to rotate by a motor M5.

The bin assembly 30 comprises a stack of twenty bins $\mathbf{31}_1$ through $\mathbf{31}_{20}$, and the bins 31 are disposed at uniform intervals. Each of the bins 31 is inclined, and a pin 32 is provided at the lower end of each bin 31. The pins 32 provided to the respective bins 31 are in engagement with a spiral groove formed on a circumferential surface of a drive shaft (not shown). The drive shaft is rotated in forward and reverse directions by a motor M6, and one revolution of the drive shaft elevates or lowers the bins 31 by one pitch. The position of the bin assembly 30 which is shown by the solid line in FIG. 2 is its lowest position (home position), where the first bin $\mathbf{31}_1$ faces the stapling unit 70. This position of the first bin $\mathbf{31}_1$ is hereinafter referred to as level $X_1$. Then, one revolution (in the forward direction) of the drive shaft elevates the first bin $\mathbf{31}_1$ to level $X_2$, where the bin $\mathbf{31}_1$ receives a sheet from the sheet conveyer section 80. Additional one revolution of the drive shaft elevates the first bin $\mathbf{31}_1$ to level $X_3$, where sheets are taken out of the bin $\mathbf{31}_1$.

The bin assembly 30 is provided with a first and a second chucking unit 40 and 40*a*, each of which pinches a stack of sheets at a side portion to pull the stack out of a bin 31 or to return the stack into the bin 31. The first chucking unit 40 is disposed in a position to handle a stack of sheets in a bin 31 set at the level $X_1$. The second chucking unit 40*a* is disposed in a position to handle a stack of sheets in a bin 31 set at the level $X_3$. The chucking units 40 and 40*a* are mounted on a single movable frame (not shown) at different levels and are capable of moving along the inclination of the bins 31 together with the movable frame. Each of the chucking units 40 and 40*a* is movable between a chucking position $Y_1$ and a pulling-out position $Y_2$ and pulls a stack of sheets out of the bin 31 set at the level $X_1$ or the level $X_3$ by a distance between $Y_1$ and $Y_2$.

Also, at the lower end of each bin 31, a stopper 34 for regulating the lower edges of sheets conveyed onto the bin 31. The stopper 34 is usually set in a vertical posture as shown by the solid line in FIG. 2 by a spring member (not shown). Each of the chucking units 40 and 40*a* has a rod (not shown), and while each of the chucking units 40 and 40*a* is moving from the chucking position $Y_1$ to the pulling-out position $Y_3$, the rod lays down the stopper 34, thereby permitting sheet take-out from the bin 31.

Next, the sheet conveyer gate 100 is described.

The sheet conveyer gate 100, as shown in FIG. 2, is a box 101 enclosing a pair of rollers 102 and 103 and provided with sheet guide plates 104 and 105. The rollers 102 and 103 can be driven to rotate in forward and reverse directions by a motor M21. The sheet conveyer gate 100 can be elevated and lowered, guided by a guide member not shown, and a motor M20 is provided as the drive source. The home position of the sheet conveyer gate 100 is shown by the solid line in FIG. 2. In the home position, the sheet conveyer gate 100 conveys a sheet which has been delivered from the receiving rollers 81 with the guide of the upper surface of the diverter 82 to the left in FIG. 2 with the rotation of the rollers 102 and 103 to deliver the sheet onto the non-sort tray 20.

Figure 5C:
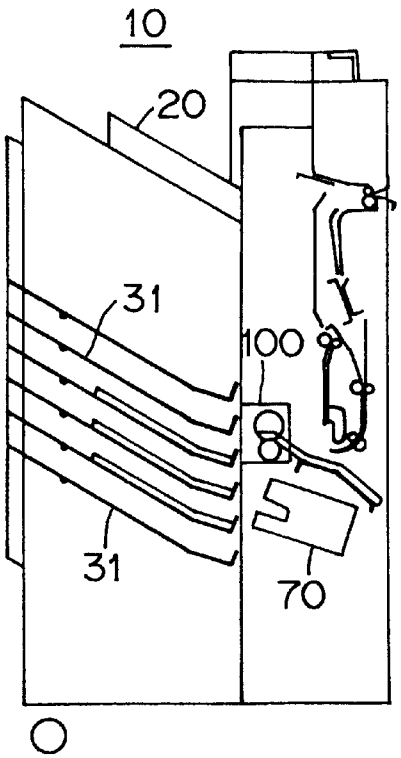
FIGS. 5*a* through 5*f* are illustrations which show a stapling process and a sheet stack taking-out/stacking process carried out in the staple sorter.
Figure 5B:
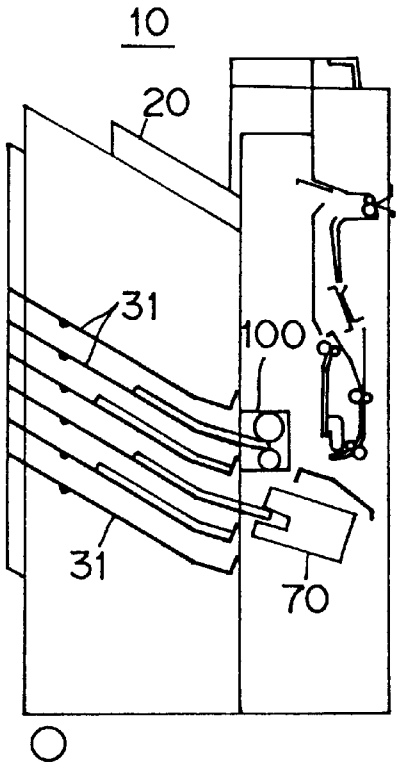
Figure 5A:
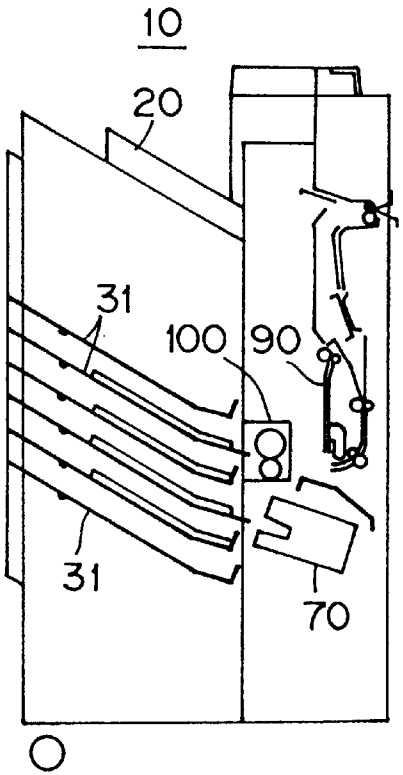
Figure 5F:
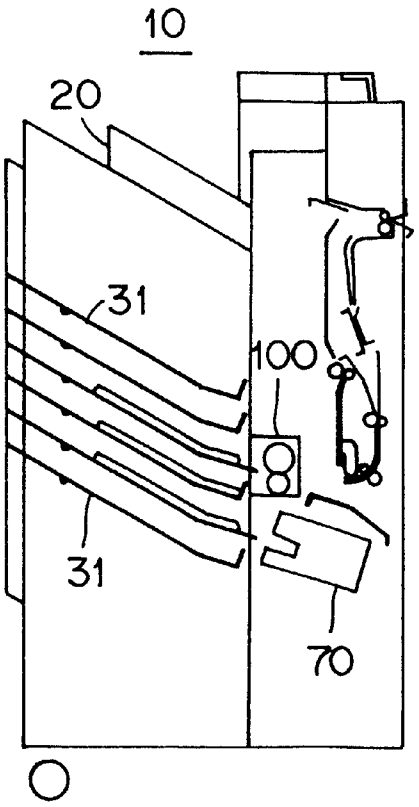
Figure 5E:
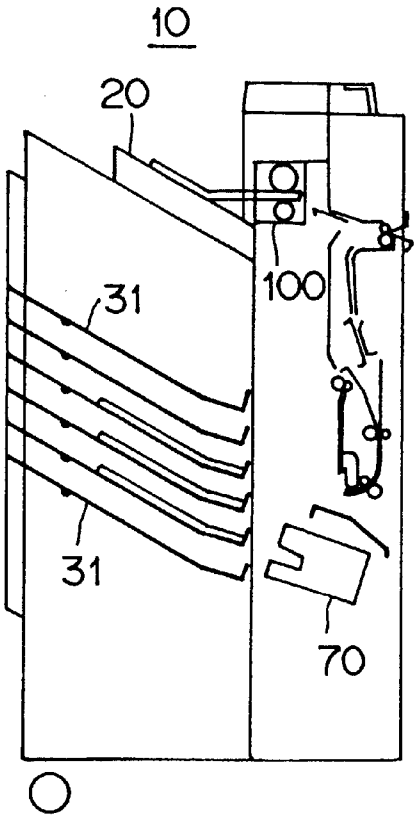
Figure 5D:
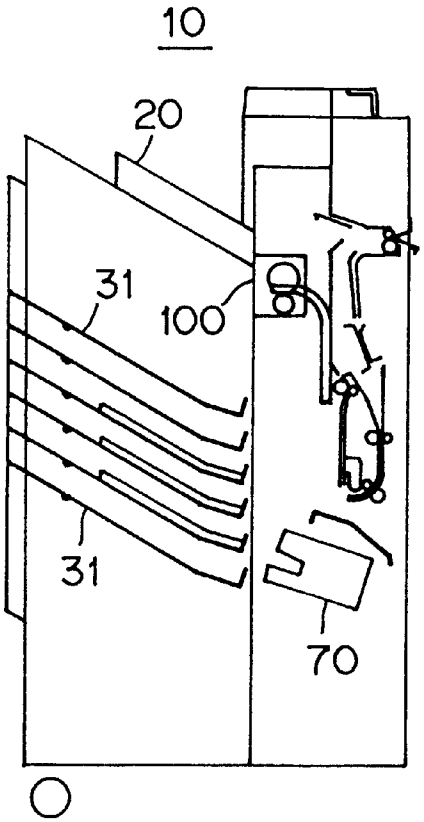

On the other hand, the sheet conveyer gate 100 is capable of moving down to a position to face the bin 31 set at the level $X_3$ in order to receive a stapled stack of sheets (see FIG. 5*a*). In the receiving position, the gate 100 pinches with the rollers 102 and 103 the stack of sheets which has been pinched and pulled out of the bin 31 by the second chucking unit 40*a* (see FIG. 5*b*). The second chucking unit 40*a* releases the stack of sheets, and simultaneously, the rollers 102 and 103 are driven to rotate forward. Thereby, the stack of sheets are taken out of the bin 31 (see FIG. 5*c*). When the stack of sheets completely comes out of the bin 31, the forward rotation of the rollers 102 and 103 is stopped, and simultaneously, the gate 100 starts moving up (see FIG. 5*d*). When the gate 100 comes to a predetermined height, the rollers 102 and 103 are rotated in reverse to eject the stack of sheets onto the non-sort tray 20 (see FIG. 5*e*). Then, the gate 100 moves down to the receiving position again (see FIG. 5*f*) to repeat the operation.

Next, the stapling unit 70 is described.

The stapling unit 70 has a well-known motorized structure and comprises a head 71 where a cartridge containing stales can be attached and detached and an anvil 72 for receiving and folding a staple driven by the head 71. The stapling unit 70 staples a stack of sheets in the end portion which has been pulled by the first chucking unit 40 out of the bin 31 set at the level $X_1$, at either one point in a corner or two points in the center. The home position of the stapling unit 70 is the front side of the staple sorter 10 and is movable toward the rear side. On the way from the home position to the rear side, the stapling unit 70 stops at predetermined points to staple, and then, returns to the home position.

Next, the punching unit 120 is described.

Figure 3:
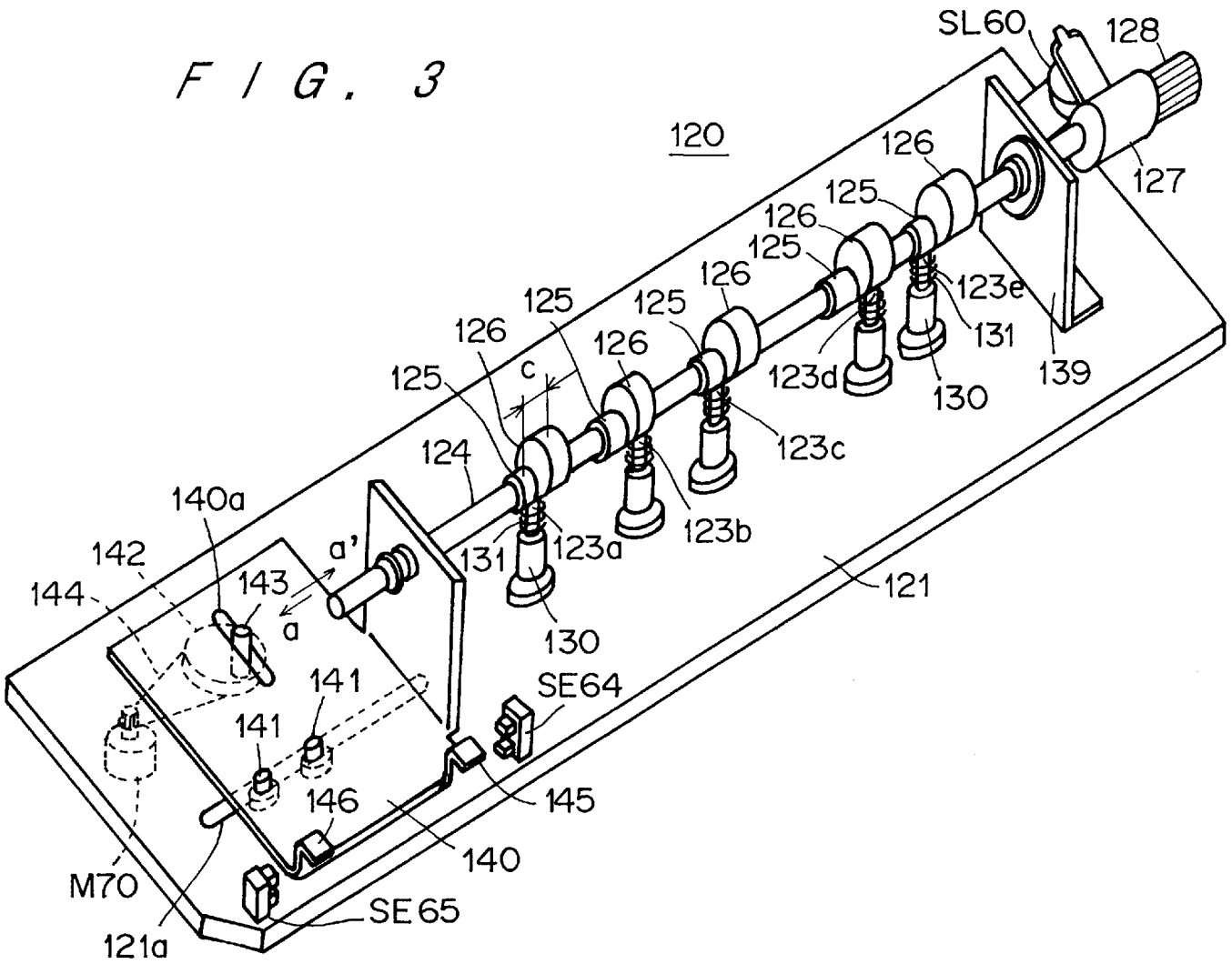
FIG. 3 is a perspective view of a punching unit provided in the staple sorter.
Figure 4A:
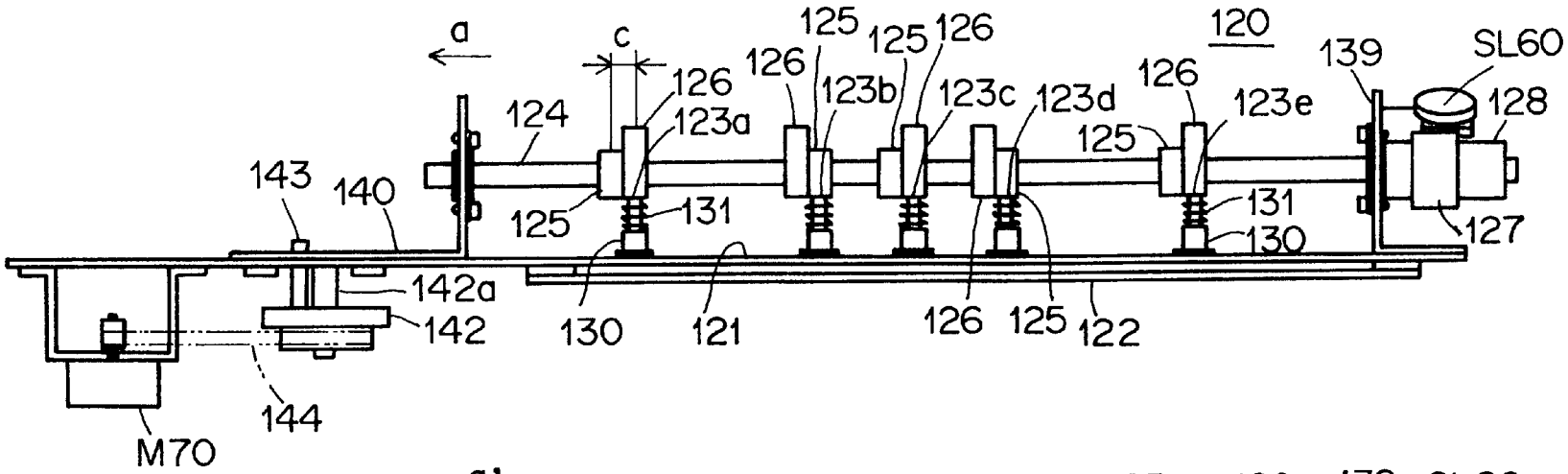
FIGS. 4*a* and 4*b* are plan views of the punching unit, FIG. 4*a* showing the state in a three-hole mode and FIG. 4*b* showing the state in a two-hole mode.
Figure 4B:
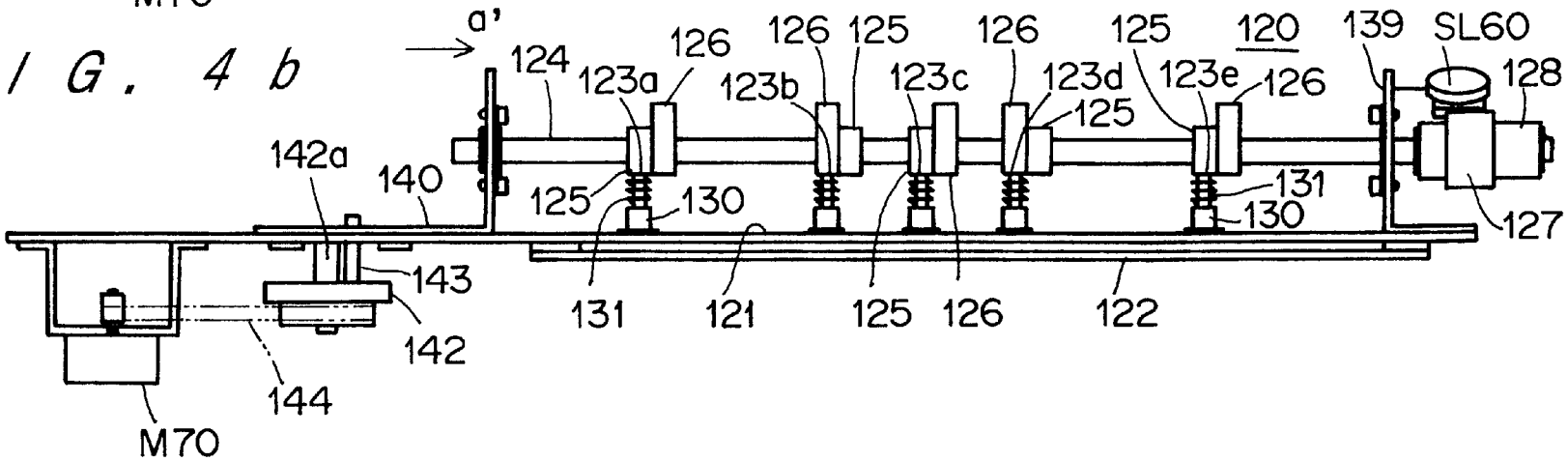

As shown in FIGS. 3, 4*a* and 4*b*, the punching unit 120 comprises plates 121 and 122 which also act as guides of a sheet, five punching rods 123*a* through 123*e* each of which has a blade, a drive shaft 124, five pairs of circular cam 125 and eccentric cam 126, a 360-degree rotary clutch 127, a flapper solenoid SL60, a switching board 140 provided with a motor M70. Each of the punching rods 123*a* through 123*e* is inserted in a guide cylinder 130 which is fixed on the plate 121 so as to be capable of sliding in the cylinder 130, and is pulled in a direction to separate from the plate 122 toward the plate 121 by a coil spring 131. The pairs of cams 125 and 126 are fitted around the drive shaft 124 at positions to face the respective punching rods 123*a* through 123*e*. The plate 122 has dies (not shown) into which the tips of the punching rods 123*a* through 123*e* are to be inserted, respectively.

The three punching rods 123*a*, 123*c* and 123*e* of the five are used to make three holes in a sheet, and the other two rods 123*b* and 123*d* are used to make two holes in a sheet. In order to switch operations for three holes and for two holes, the drive shaft 124 is capable of reciprocating in its axial direction. More specifically, an end of the drive shaft 124 is loosely supported by a fixed plate 139 to be capable of rotating and sliding therein, and the other end thereof is supported by the switching board 140 to be capable of rotating but not capable of sliding. The switching board 140 has pins 141, and the pins 141 are in engagement with a guide groove 121*a* formed on the plate 121. With the pins 141 guided by the guide groove 121*a*, the switching board 140 is capable of sliding on the plate 121 in the directions of arrows "a" and "a'". Also, the switching board 140 has a slot 140*a*, and a pin 143 which stands on a switching cam 142 at a position out of the center 142*a* of the cam 142 is in engagement with the slot 140*a*. The switching cam 142 is driven by a motor M70 via a belt 144 to rotate in one direction. A 180-degree rotation of the switching cam 142 makes the switching board 140 slide in the direction of arrow "a" or "a'", which is accompanied by a slide of the drive shaft 124 in the same direction. The slide pitch of the switching board 140 is equal to the distance c between the cams 125 and 126 in a pair.

When the switching board 140 and the drive shaft 124 slide in the direction of "a" and come to a state shown by FIG. 4*a*, the punching rods 123*a*, 123*c* and 123*e* are in contact with the respective eccentric cams 126, and the punching rods 123*b* and 123*d* are in contact with the respective circular cams 125. In this state, with a 360-degree rotation of the drive shaft 124, the rods 123*a*, 123*c* and 123*e* which are in contact with the eccentric cams 126 make one stroke, thereby making three holes in a sheet placed between the plates 121 and 122. At this time, the rods 123*b* and 123*d* which are in contact with the circular cams 125 do not move. On the other hand, when the switching board 140 and the drive shaft 124 slide in the direction of "a'" and come to a state shown by FIG. 4*b*, the punching rods 123*b* and 123*d* are in contact with the respective eccentric cams 126, and the punching rods 123*a*, 123*c* and 123*e* are in contact with the respective circular cams 125. In this state, with a 360-degree rotation of the drive shaft 124, the rods 123*b* and 123*d* which are in contact with the eccentric cams 126 make one stroke, thereby making two holes in a sheet placed between the plates 121 and 122. At this time, the rods 123*a*, 123*c* and 123*e* which are in contact with the circular cams 125 do not move.

Sensors SE64 and SE65 are provided on the plate 121 to detect the position of the switching board 140. The sensor SE64 generates an ON-signal when its optical axis is interrupted by a projection 145 of the switching board 140, and at this time, it is detected that the switching board 140 is set in the position to make two holes in a sheet (two-hole mode). The sensor SE65 generates an ON-signal when its optical axis is interrupted by another projection 146 of the switching board 140, and at this time, it is detected that the switching board 140 is set in the position to make three holes in a sheet (three-hole mode).

The 360-degree rotation of the drive shaft 124 is made by the 360-degree rotary clutch 127. More specifically, the clutch 127 transmits the rotating force of a gear 128 connected to the conveyer motor M50 to the drive shaft 124 when a flapper solenoid SL60 is turned on temporarily, and thereby, the drive shaft 124 makes a rotation. The 360-degree rotary clutch 127 is a well-known type which has a built-in mechanism comprising a kick spring and so on. The punch timing is controlled based on the time when a sensor (not shown) disposed near the punching unit 120 detects the leading edge or the trailing edge of a sheet conveyed in the first conveyer section 83.

Figure 6:
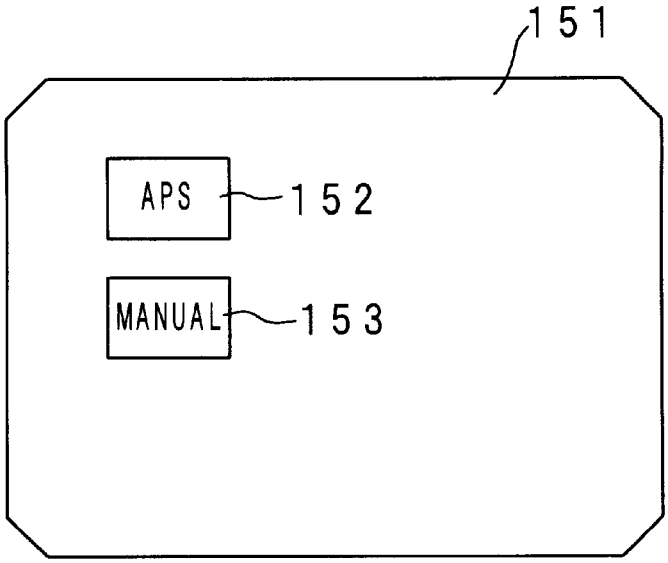
FIG. 6 is a plan view of a screen for selection of a sheet size displayed on a touch panel on an operation panel of the copying machine.
Figure 7:
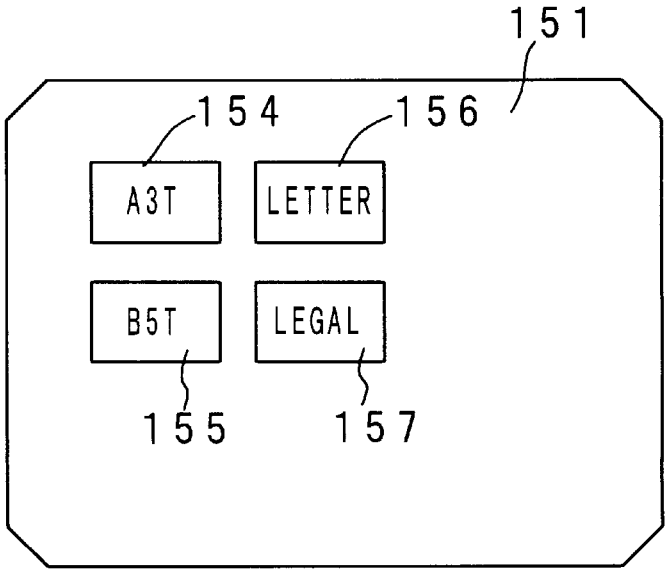
FIG. 7 is a plan view of a screen for manual selection of a sheet size displayed on the touch panel.

FIGS. 6 and 7 show screens of a liquid crystal display touch panel 151 on an operation panel provided on the copying machine 1. FIG. 6 shows a screen for selection of a sheet size, and the operator touches either an APS key 152 or a manual key 153 displayed on the panel 151. The APS key 152 is to set an automatic paper selection mode, in which the optimal sheet size is automatically selected based on the size of a document set on the platen glass and the magnification ratio. When the manual key 153 is turned on, the screen of the touch panel 151 changes to one shown by FIG. 7. In the screen, keys 154 through 157 with which the operator selects the sheet size are displayed. The operator turns on either one of the keys 154 through 157, and the corresponding sheet size is selected.

Further, on the touch panel 151, a screen for selection of a sorter operation mode (not shown) among the punch mode, the sort mode, the group mode, the staple mode and the stack mode can be also displayed. The punch mode is selected with the screen.

Figure 8:
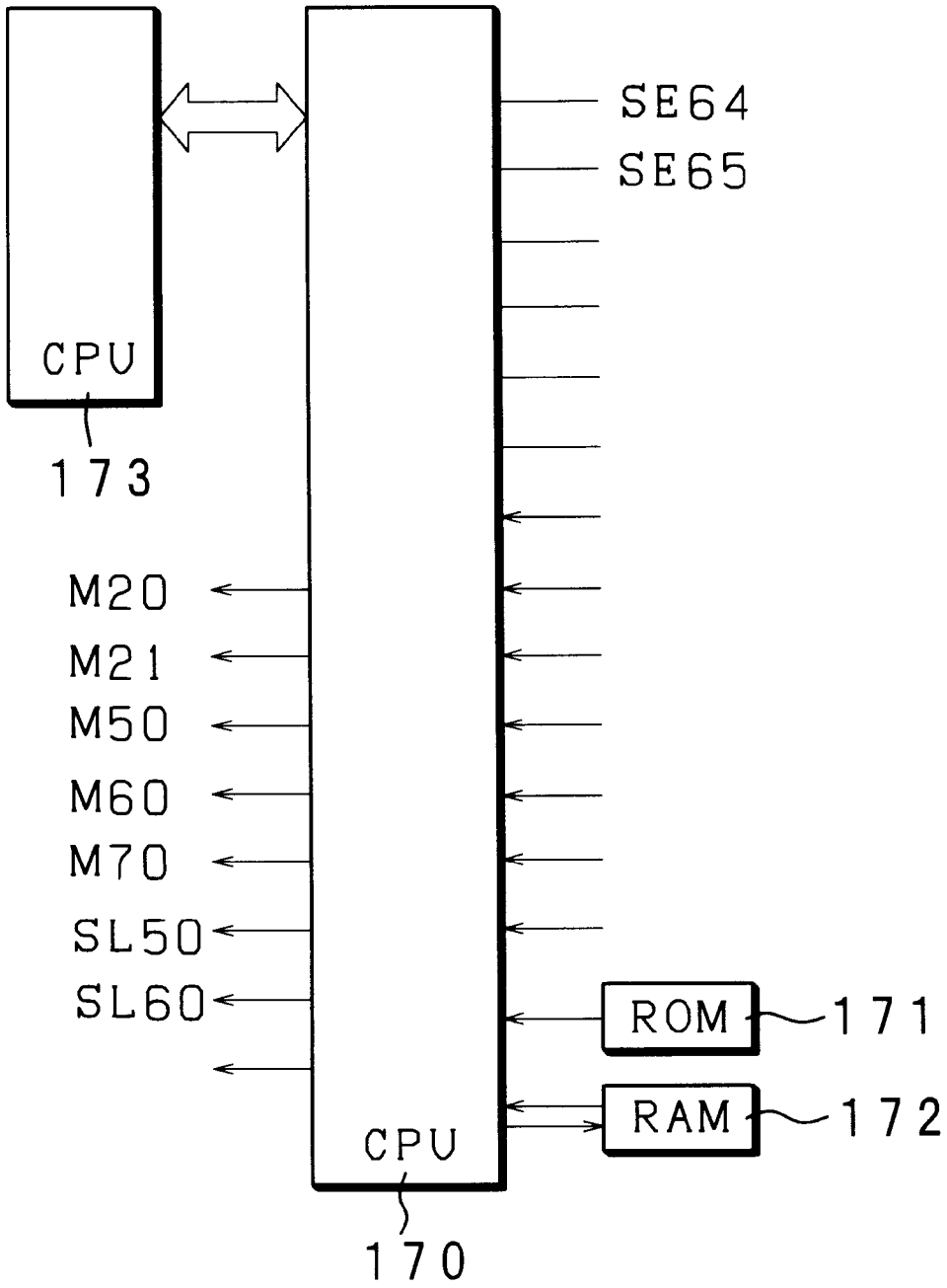
FIG. 8 is a block diagram of the control circuitry of the copying machine and the staple sorter.

FIG. 8 shows a control circuitry of the copying machine 1 and the staple sorter 10. The center of the control circuitry is a CPU 170 incorporating a ROM 171 and a RAM 172, and the CPU 170 controls the motors M20, M21, M50, M60, M70, the solenoids SL50, SL60, etc., following a program stored in the ROM 171. The CPU 170 receives detection signals from the sensors SE64, SE65, etc. Further, the CPU 170 communicates with other CPUs, for example, with a CPU 173 which controls the automatic document feeder 5 to exchange necessary data.

Figure 9:
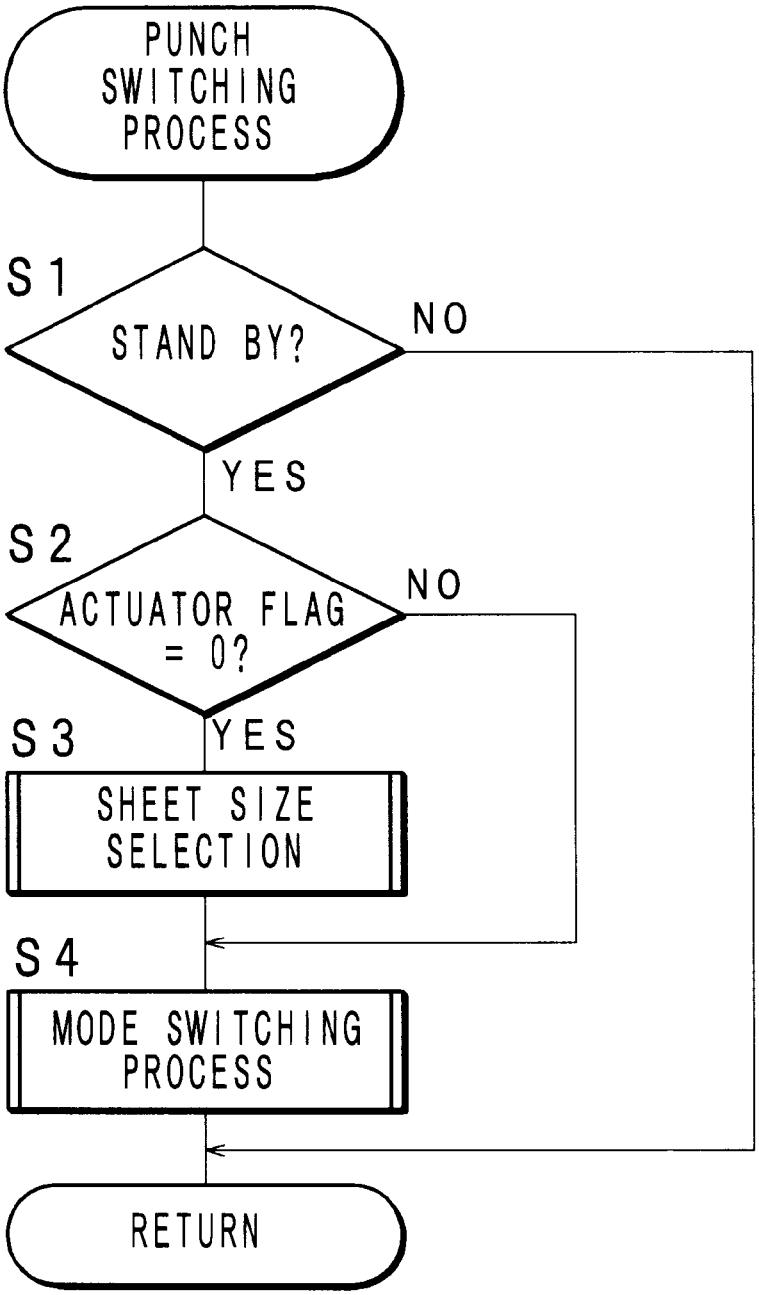
FIG. 9 is a flowchart which shows a control procedure for a punch switching process.
Figure 10:
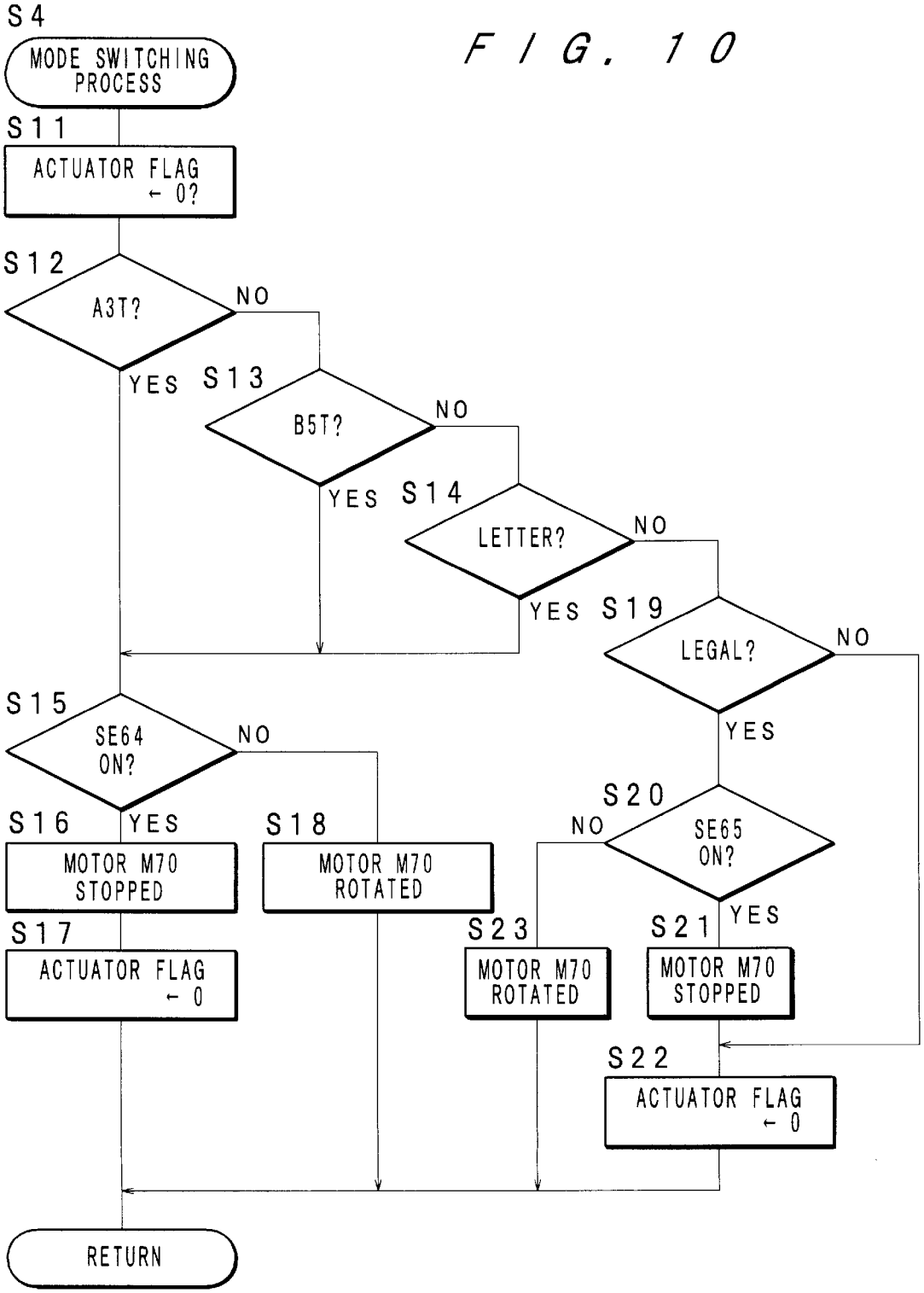
FIG. 10 is a flowchart which shows a control procedure for a punch operation mode switching process.

FIGS. 9 and 10 show a control procedure for switching the operation mode of the punching unit 120 between the two-hole mode and the three-hole mode. In the present invention, the suitable punch operation mode is predetermined depending on the sheet size. For example, the two-hole mode is taken for a sheet size of A3T, B5T or a letter size, and the three-hole mode is taken for the legal size. This arrangement saves the operator trouble in manually selecting the two-hole mode or the three-hole mode suited for the sheet size, and misselection can be avoided. Further, "T" means that a sheet is set with its longer sides parallel to the sheet conveying direction.

When a punch switching process is called during the main routine of the CPU 170, as shown in FIG. 9, first, it is confirmed at step S1 that the copying machine 1 is standing by. Then, at step S2, an actuator flag is checked. If the actuator flag is "0", a sheet size is selected at step S3. In this step, a sheet size is selected with the screens of the touch panel 151 shown by FIGS. 6 and 7. Next, at step S4, the punch operation mode is switched to one suited for the selected sheet size. Then, the program returns to the main routine.

FIG. 10 shows a subroutine for the punch operation mode switching process. In this subroutine, first, the actuator flag is set to "1" at step S11. Then, if the sheet size is judged to be A3T, B5T or letter size at step S12, S13 or S14, the sensor SE64 is checked whether on or not at step S15. As described above, the sensor SE64 detects that the switching board 140 and the drive shaft 124 are set for the two-hole mode. Accordingly, if the sensor SE64 is on, the motor M70 is stopped at step S16, and the actuator flag is reset to "0" at step S17. Then, the program returns to the main routine. If the sensor SE64 is off, the motor M70 is rotated at step S18, and the program returns to the main routine. Thereafter, when the judgment at step S15 becomes "YES", the program proceeds to steps S16 and S17.

On the other hand, if the sheet size is judged to be legal size at step S19, the sensor S65 is checked whether on or not at step S20. As described above, the sensor SE65 detects that the switching board 140 and the drive shaft 124 are set for the three-hole mode. Accordingly, if the sensor SE65 is on, the motor M70 is stopped at step S21, and the actuator flag is reset to "0" at step S22. Then, the program returns to the main routine. If the sensor SE65 is off, the motor M70 is rotated at step S23, and the program returns to the main routine. Thereafter, when the judgment at step S20 becomes "YES", the program proceeds to steps S21 and S22.

Further, in the description above, the relationship between the sheet size and the suitable punch operation mode has been provided as an example.

Second Embodiment; See FIGS. 11–14*a* and 14*b*

The second embodiment is a staple sorter which has a registering function wherein the operator can register a desired punch operation mode for each sheet size. The staple sorter as a whole has the same structure as that shown in FIG. 2.

Figure 11:
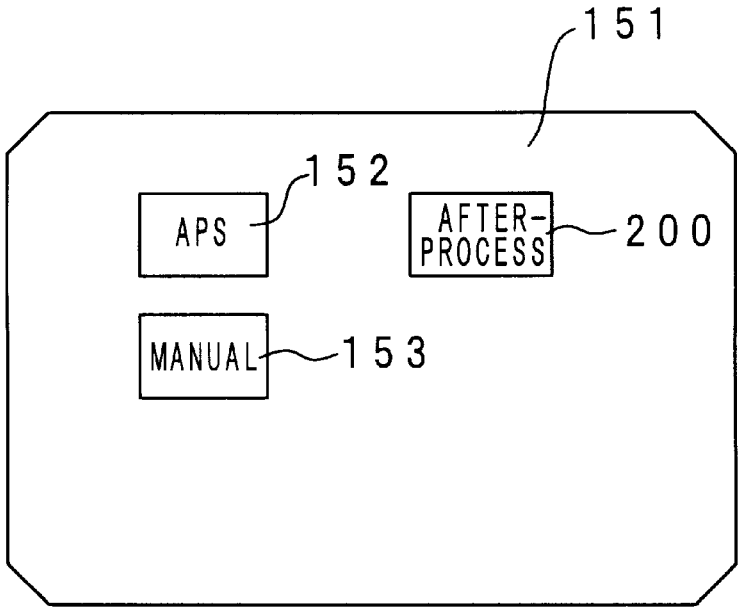
FIG. 11 is a plan view of a screen for selection of a sheet size displayed on the touch panel in a second embodiment of the present invention.
Figure 12:
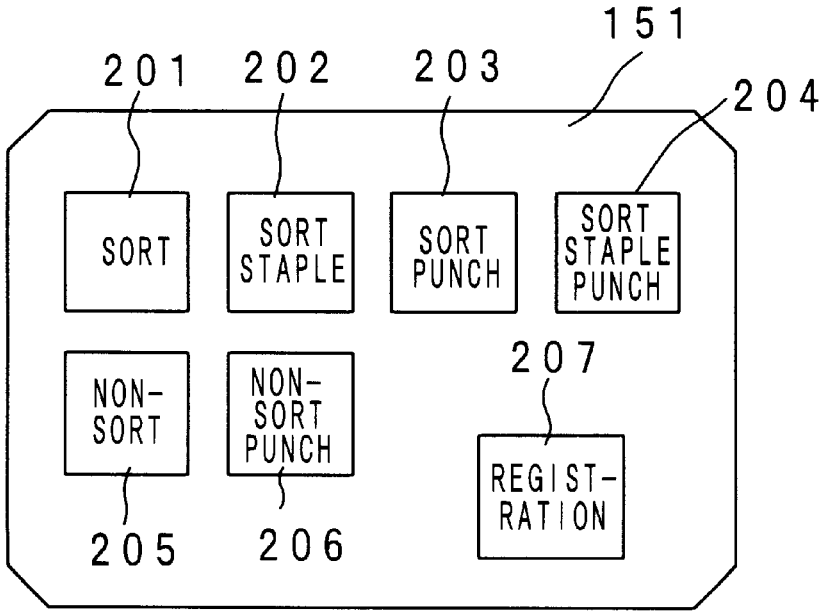
FIG. 12 is a plan view of a screen for selection of a sorter operation mode displayed on the touch panel in the second embodiment.

FIG. 11 shows a screen of the touch panel 151 for selection of a sheet size according to the second embodiment. On this screen, not only the APS key 152 and the manual key 153 but also an after-process key 200 is displayed. When the after-process key 200 is turned on, a screen shown by FIG. 12 for selection of a sorter operation mode appears on the touch panel 151. On this screen, a registration key 207 is displayed as well as keys 201 through 206 for setting the respective sorter operation modes. The registration key 207 is provided so that the user can register a punch operation mode suited for each sheet size beforehand by his/her own decision.

Figure 13:
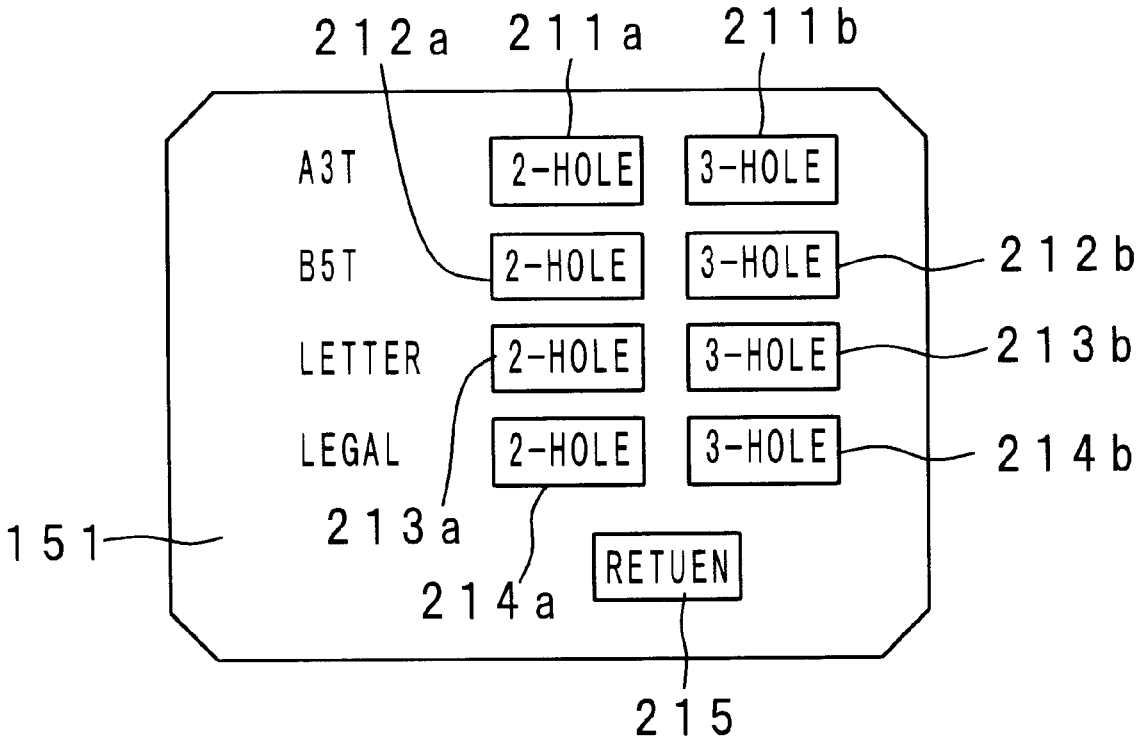
FIG. 13 is a plan view of a screen for registration of desired punch operation modes displayed on the touch panel in the second embodiment.

When the registration key 207 is turned on, a registration screen shown by FIG. 13 appears on the touch panel 151. On the registration screen, two-hole mode registering keys 211*a* through 214*a* and three-hole mode registering keys 211*b* through 214*b* are displayed for the respective sheet sizes, and further, a return key 215 is displayed. When the operator touches either the two-hole mode registering key or the three-hole mode registering key for each sheet size, the selection is stored in a non-volatile memory.

Initially, as shown in FIG. 10, the staple sorter is so set that the two-hole mode will be selected for an A3T size, a B5T size or a letter size and that the three-hole mode will be selected for a legal size. By turning on the registration key 207 to display the registration screen and turning on either of the keys 211*a* through 214*b* on the registration screen, the operator can change the suitable punch operation mode for each sheet size from the initial settings, and the changes are stored in the non-volatile memory. Then, when the operator turns on a print key (not shown) while the registration screen shown by FIG. 13 is on the touch panel 151, the punching process is carried out in the mode registered with the screen. When the return key 215 is turned on, the screen shown by FIG. 12 comes back on the touch panel 151.

Figure 14A:
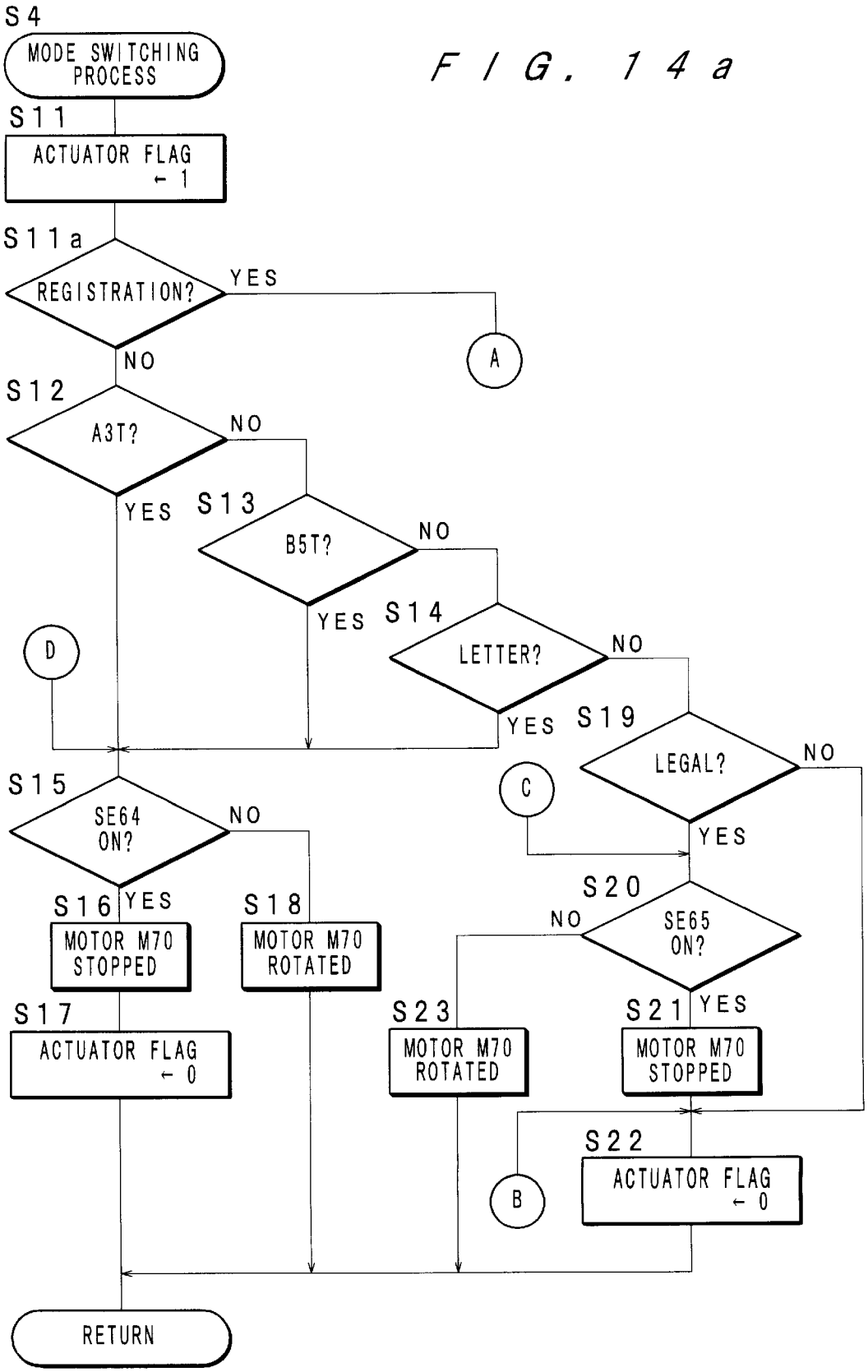
FIGS. 14*a* and 14*b* are flowcharts which show a control procedure for a punch operation mode switching process in the second embodiment.
Figure 14B:
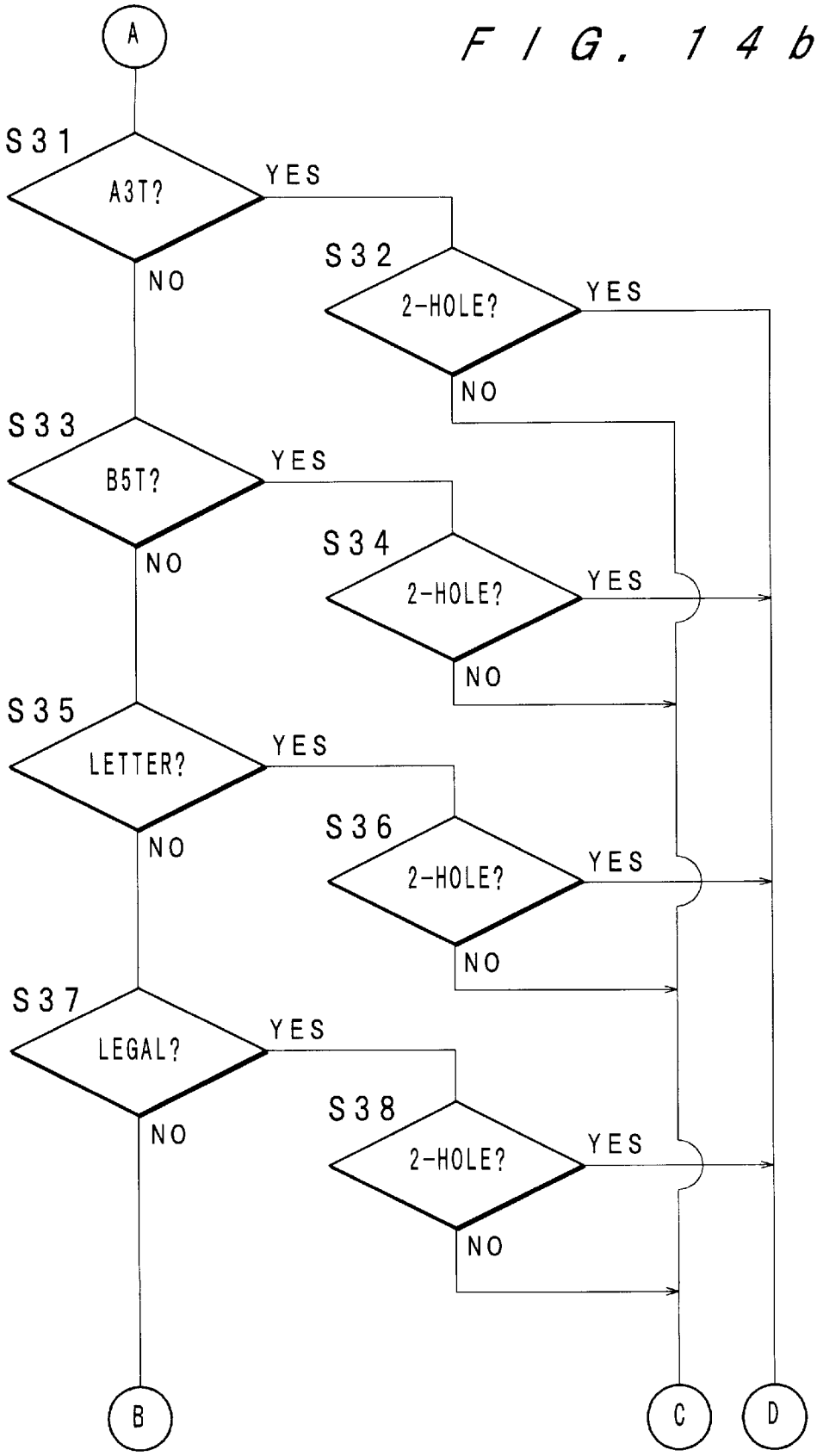

FIGS. 14*a* and 14*b* show a control procedure for the punch operation mode switching process according to the second embodiment. This procedure is carried out as a substitution of the procedure shown by FIG. 10. In FIG. 14*a*, the steps provided with the same reference numbers as those in FIG. 10 are to perform the same processes as those in the procedure of FIG. 10.

In this subroutine, first, the actuator flag is set to "1" at step S11, and it is judged at step S11*a* whether the registration by the operator has been carried out. More specifically, it is judged whether the registration screen shown by FIG. 13 is displayed by a turn-on of the registration key 207 on the screen shown by FIG. 12. If the registration screen is not displayed, the program proceeds to steps S12 through S23 as in the first embodiment, and the punch operation mode which is initially set for the sheet size is selected.

On the other hand, if it is judged that the registration by the operator has been carried out, that is, if the registration screen shown by FIG. 13 is displayed, the sheet size is judged at steps S31, S33, S35 and S37, and the punch operation mode which has been registered for the sheet size by the operator is judged at step S32, S34, S36 and S38. When the judgment at step S32, S34, S36 or S38 is "YES", the program proceeds to step S15 to set the punching unit 120 for the two-hole mode. When the judgment at step S32, S34, S36 or S38 is "NO", the program proceeds to step S20 to set the punching unit 120 for the three-hole mode.

Figure 15:
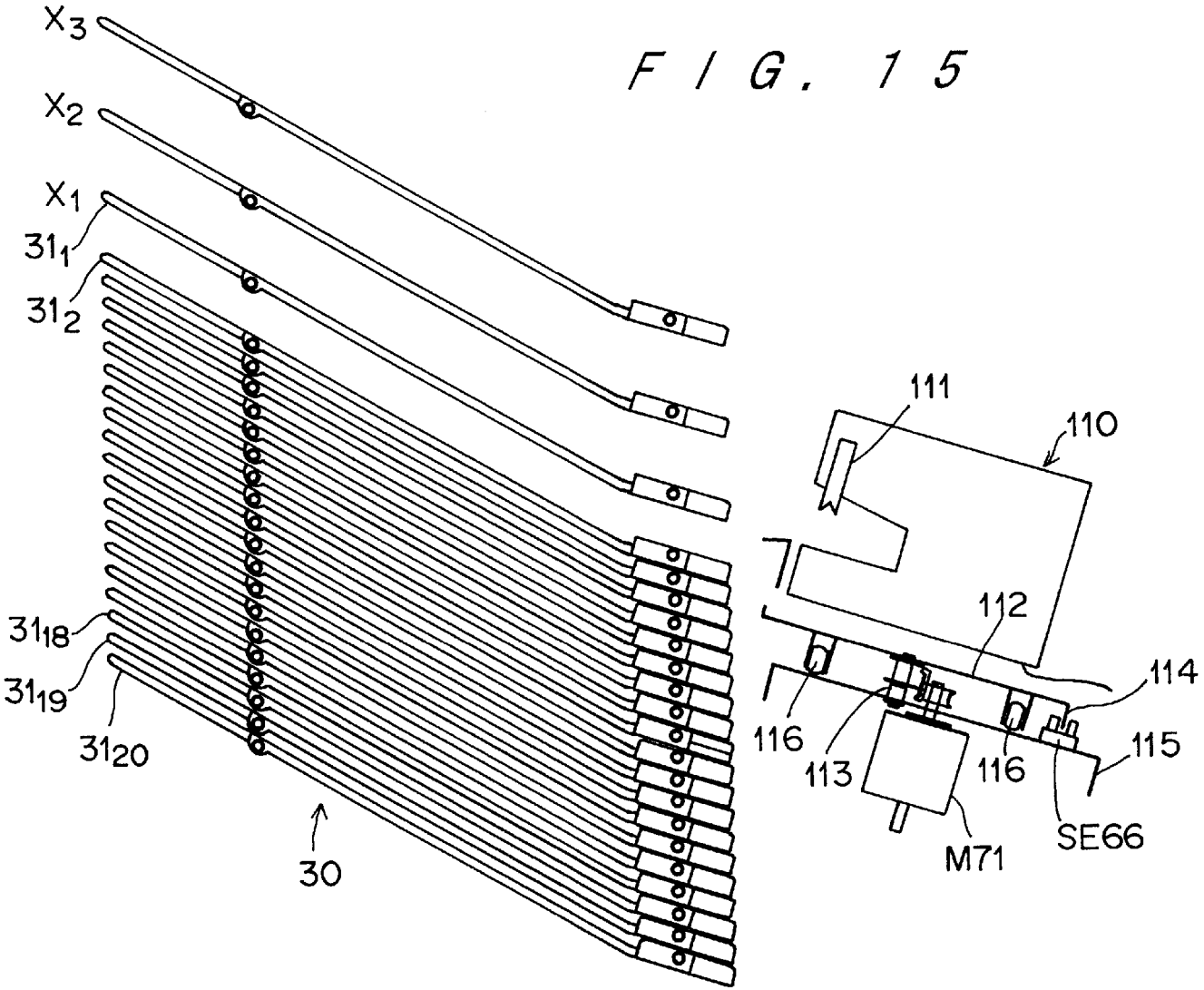
FIG. 15 is an elevational view of the main part of a staple sorter which is a third embodiment of the present invention.

Third Embodiment; See FIGS. 15 and 16

The third embodiment is a staple sorter which punch a stack of sheets on a bin 31 at a time.

The staple sorter of the third embodiment generally has the same structure as shown by FIG. 2, but this staple sorter is provided with a punching unit 110 in the position of the stapling unit 70. The punching unit 110 punches a stack of sheets pulled by the first chucking unit 40 out of the bin 31 set at the level $X_1$. The punching unit 110 has a single punching rod 111. The punching rod 111 moves in parallel to the edge of the stack of sheets, and on the way, the punching rod 111 stops at specified positions to make holes.

The punching unit 110 is mounted on a carrier 112 which has rollers 116 and is movable on a guide plate 115, and the carrier 112 is connected to a belt 119 which is driven by a motor M71 to rotate in forward and reverse directions. A guide groove 117 is formed on the guide plate 115, and pins 113 which stands on the reverse side of the carrier 112 are in engagement with the guide groove 117. Thereby, the carrier 112 (and the punching unit 110) is guided to move along the edge of the stack of sheets S. The carrier 112 has a projection 114, and the position where the projection 114 is detected by a sensor SE66 is the home position of the punching unit 110 (see the alternate long and short dash line in FIG. 16).

Figure 16:
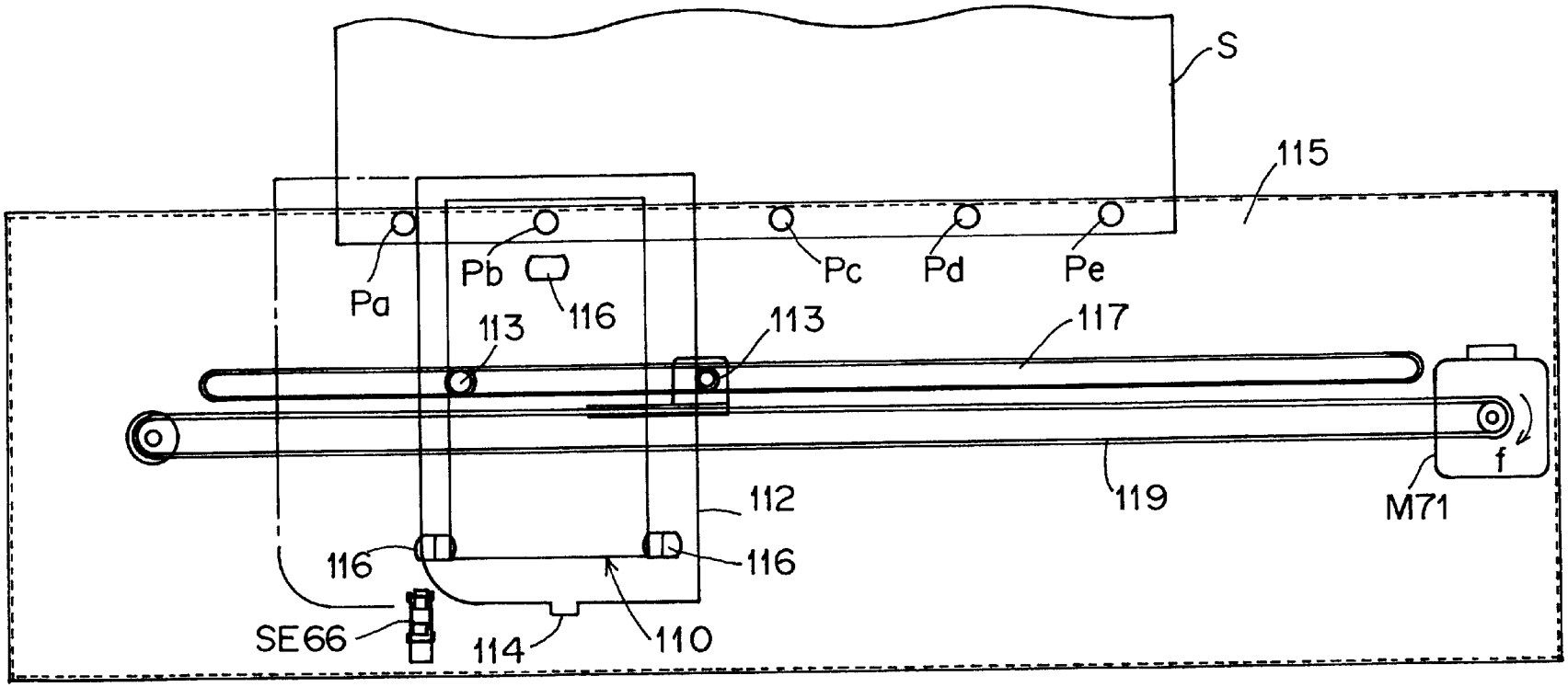
FIG. 16 is a plan view of a punching unit provided in the staple sorter shown in FIG. 15.

In FIG. 16, the reference symbols Pa through Pe show positions at which holes are to be made. In the three-hole mode, holes are made at the positions Pa, Pc and Pe, and in the two-hole mode, holes are made at the positions Pb and Pd. A hole is made at the position Pa by driving the punching rod 111 while the punching unit 110 is in the home position. In order to make a hole at each of the positions Pb through Pe, the motor M71 is rotated in a direction of arrow "f" to move the punching unit 110 to a specified position, and the punching rod 111 is driven there. The stop of the punching unit 110 at positions to make holes at the positions Pb through Pe can be controlled by providing sensors for detecting the projection 114 on a way where the projection 114 passes, by detecting the number of revolutions of the motor M71 with an encoder or by using a pulse motor as the motor M71 and counting the number of pulses.

As in the first embodiment, the punch operation mode is switched between the two-hole mode and the three-hole mode in accordance with the sheet size. Also, it is possible to so modify the third embodiment that the operator can register a desired punch operation mode for each sheet size with the operation panel as in the second embodiment.

Other Embodiments

The structures of the bin assembly 30 and the sheet conveyer section 80 can be arbitrarily designed. For example, if the copying machine or the printer is a type which has an image memory and prints a desired number of sets, each set being printed in order of page, the bin assembly 30 may have only one bin 31. In another case, a staple bin for exclusive use may be provided separate from sort bins.

The present invention is applicable to a staple sorter which can be connected not only to the copying machine 1 but also to a printer which outputs image information transmitted from a host computer as a hard copy.

Further, the means for registering a desired punch operation mode may be switches as well as the operation panel 151.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A finisher which punches a sheet comprising:

a plurality of punching rods for making holes in a sheet;

a drive shaft which rotates to drive the plurality of punching rods;

a plurality of converting members which are fitted to the drive shaft at positions to face the punching rods respectively so as to convert a rotary movement of the drive shaft into linear movements of the plurality of punching rods; and a switching mechanism which actuates a specified one of the plurality of converting members selectively.

2. The finisher as claimed in claim 1, wherein:

each of the converting members is a pair of circular cam and eccentric cam which are fitted around the drive shaft and are adjacent to each other in the axial direction of the drive shaft; and the switching mechanism moves the drive shaft in the axial direction reciprocally at a specified pitch so as to make the circular cam or eccentric cam in each pair come into contact with each of the punching rods.

3. A finisher which punches a sheet comprising:

a plurality of punching rods for making holes in a sheet;

a selector which selects a punching rod to be operated from said plurality of punching rods;

a driving mechanism which energizes said punching rod selected by said selector; and a controller which determines a punching rod to be selected by said selector in accordance with a length and width of a sheet to be punched and controls said selector based on the determination.

4. A punching method used in a finisher having a plurality of punching rods for making holes in a sheet, the method comprising steps of:

receiving a sheet to be punched;

entering a size of the sheet to be punched;

automatically selecting a punching rod to be operated from said plurality of punching rods based on a length and width of the sheet to be punched; and energizing said punching rod selected in said selecting step.

5. A finisher which punches a sheet comprising:

a plurality of punching rods for making holes in a sheet;

a drive shaft;

a plurality of cam pairs each pair including a circular cam and an eccentric cam positioned adjacent to each other in an axial direction of the drive shaft with each cam being fitted around the drive shaft; and an electronic switching mechanism configured to reciprocally move the drive shaft in the axial direction to selectively position one of either the circular cam and the eccentric cam of each cam pair to face a respective punching rod, wherein the drive shaft rotates, rotating the plurality of cam pairs, and positioning the eccentric cam to face a respective punching rod converts the rotary movement of the drive shaft into linear movements of the respective punching rod while positioning the circular cam to face the respective punching rod results in no movement of the respective punching rod during rotary movement of the drive shaft.

6. The finisher according to claim 5, further comprising:

automatic control means for controlling the switching mechanism to move the drive shaft to one of first and second reciprocal positions in response to a detected sheet size of the sheet to be punched.

7. The method of claim 4, further comprising:

the sheet to be punched is provided from a copy machine having a platen glass receiving a sheet to be copied, and entering a size of the sheet to be punched is automatically carried out in accordance with the size of the sheet to be copied on the platen glass.

* * * * *